US008579084B2

(12) United States Patent
Becker et al.

(10) Patent No.: US 8,579,084 B2
(45) Date of Patent: Nov. 12, 2013

(54) FOUNDING SYSTEM

(75) Inventors: Allan James Becker, Concord (CA); Stephen Wilson, Edmonton (CA)

(73) Assignee: Brand Services, LLC, Kennesaw, GA (US)

( * ) Notice: Subject to any disclaimer, the term of this patent is extended or adjusted under 35 U.S.C. 154(b) by 597 days.

(21) Appl. No.: 12/800,389

(22) Filed: May 14, 2010

(65) Prior Publication Data

US 2010/0288583 A1 Nov. 18, 2010

(30) Foreign Application Priority Data

May 14, 2009 (CA) ..... 2666003

(51) Int. Cl.
*E04G 1/36* (2006.01)

(52) U.S. Cl.
USPC ..... 182/128; 248/200; 248/210; 248/238

(58) Field of Classification Search
USPC ..... 182/128, 120–122; 248/200, 210, 238, 248/205.1, 237
See application file for complete search history.

(56) References Cited

U.S. PATENT DOCUMENTS

| | | | | | |
|---|---|---|---|---|---|
| 718,602 | A * | 1/1903 | Chase | 248/237 |
| 960,565 | A * | 6/1910 | Levander | 248/237 |
| 1,864,457 | A * | 6/1932 | Nelson | 248/237 |
| 1,960,863 | A * | 5/1934 | Troy | 248/238 |
| 2,299,323 | A * | 10/1942 | Hetky | 248/237 |
| D158,136 | S * | 4/1950 | Simon | D25/69 |
| 2,549,638 | A * | 4/1951 | Rogghe | 248/237 |
| 2,606,079 | A * | 8/1952 | White | 182/121 |
| 4,342,374 | A * | 8/1982 | Montana | 182/45 |
| 4,496,026 | A * | 1/1985 | Meehan | 182/128 |
| 4,671,382 | A * | 6/1987 | D'Alessio et al. | 182/128 |
| 5,318,148 | A * | 6/1994 | Franco et al. | 182/45 |
| 5,927,665 | A * | 7/1999 | Grabnic | 248/200 |
| 6,045,102 | A * | 4/2000 | Terenzoni | 248/238 |
| 7,509,702 | B2 * | 3/2009 | Cantis et al. | 14/78 |
| 2004/0165951 | A1 * | 8/2004 | Fukui | 404/71 |
| 2006/0225960 | A1 * | 10/2006 | Ferlin et al. | 182/138 |
| 2007/0252056 | A1 * | 11/2007 | Novin | 248/205.1 |
| 2008/0105800 | A1 * | 5/2008 | Menning et al. | 248/200 |
| 2010/0288583 | A1 * | 11/2010 | Becker et al. | 182/128 |
| 2011/0011678 | A1 * | 1/2011 | Sheffield | 182/141 |
| 2012/0261362 | A1 * | 10/2012 | Skull et al. | 211/26 |

* cited by examiner

*Primary Examiner* — Katherine Mitchell
*Assistant Examiner* — Candace L Bradford
(74) *Attorney, Agent, or Firm* — Greensfelde, Hemker & Gale, P.C.; Peter S. Gilster

(57) ABSTRACT

A founding chair for a founding ladder system is of a light-weight fabricated design and includes a pivotally secured top leveling plate. A ladder system for the founding chair includes a slide in engagement rack for securing of the founding chair and allowing incremental adjustment.

18 Claims, 20 Drawing Sheets

FOUNDING SYSTEM

RELATED INVENTION

The present application claims the benefit of Canadian Application 2666003, filed May 14, 2009.

FIELD OF THE INVENTION

The present invention relates to founding ladder systems and founding chairs used in the reconditioning of systems including industrial boilers.

BACKGROUND OF THE INVENTION

Various types of boilers are used in different applications including steam boilers for generating electrical power. The electrical power may be generated for a public company or may be part of a large manufacturing process such as a paper mill.

The boilers from time to time require maintenance and this maintenance typically requires the erection of scaffolding within the boilers which can be several stories high. Access to these boilers can be limited and there can be a very significant cost associated with such a power system being down for maintenance. For many applications repairs must be completed quickly to return the unit to normal operation.

Typically the boilers include lower converging walls with an open bottom portion.

There are a number of systems for servicing such boilers including the founding ladder system disclosed in U.S. Pat. No. 4,496,026 and the scaffolding system for sloped surfaces disclosed in U.S. Pat. No. 4,671,382. Each, of these references include a system that includes an elongate beam extending between the converging walls of the boiler with support members extending and engaging the sloped boiler walls with scaffolding systems supported from these components.

The U.S. Pat. No. 4,496,026 includes a specialized scaffold leg with a 'V' shaped base portion that engages a support member of a channel cross-section. This channel effectively cradles the support leg of the scaffold and allows the scaffold to pivot in the channel. In this way the scaffold leg can be positioned vertically within the boiler. This structure requires specialized scaffold support legs as well as specialized equipment for engaging the lower converging walls of the boiler wall in combination with conventional scaffolding.

U.S. Pat. No. 4,671,382 uses a particular bracing arrangement between scaffold legs to maintain the scaffolding above a base beam. This support arrangement is again specific to the boiler application and is not assembled in the manner of conventional scaffolding.

The present invention is directed to an improved founding ladder support system as well as a unique founding chair that simplifies the installation of scaffolding within a boiler.

SUMMARY OF THE INVENTION

A founding ladder system according to the present invention includes an elongate base beam spanning between converging lower boiler walls with a pair of ladder supports secured to opposite ends of the elongate base beam and extending upwardly and outwardly from the base beam and supported by the lower boiler walls. Each ladder support releasably supports at least one founding chair having an adjustable and lockable top surface allowing leveling and locking of the top surface to compensate for changes in the angle of the ladder support.

According to an aspect of the founding ladder system each founding chair is fabricated from plate and extruded components of an aluminum alloy material.

In yet a further aspect of the founding ladder system each founding chair is of a weight less than 35 pounds and preferably between 30 and 35 pounds.

In a further aspect of the founding ladder system each ladder support includes two opposed side rails with a series of rungs extending between the side rails. Each side rail includes a pair of spaced elongate supports and an upwardly opening central slot extending in a length thereof. A series of founding chair support positions are defined within each upwardly opening central slot.

In yet a further aspect of the founding ladder system each founding chair comprises opposed side members with each side member including a front edge, a top edge and an angled diagonal edge. The diagonal edge includes a series of open slots for adjustably securing the founding chair in one of the ladder supports. Each founding chair includes a fixed top member extending between the opposed side members and generally parallel to and positioned below the top edge. A bracing arrangement extends between the opposed side members and below the fixed top member. A variable scaffold support plate is positioned above and in engagement with the fixed top member. The variable scaffold support plate includes a planar top surface and the support plate pivots on the fixed top member about an axis extending across the fixed top member.

With this arrangement an angular position of the planar top surface relative to the front edge is adjustable. The variable scaffold support plate includes a releasable locking arrangement for securing the variable scaffold support plate at different angular positions on the fixed top member.

In yet a further aspect of the founding ladder system the fixed top surface of each founding chair includes a raised central portion extending between the opposed side members and the variable support plate pivots on the raised central portion.

The invention is also directed to a founding chair for use in a founding ladder system. The founding chair includes two opposed side members with each side member including a front edge, a top edge and a diagonal edge. The diagonal edge includes a series of open notches for adjustably securing the founding chair to a founding ladder. The founding chair includes a fixed top member extending between the opposed side members and generally parallel to and positioned below the top edge. A bracing arrangement extends between the opposed side members and below the fixed top member. A variable scaffold support plate is positioned above and in engagement with the fixed top member. The variable scaffold support plate includes a planar top surface and pivots on the fixed top member about an axis extending across the fixed top member. The angular position of the planar top surface relative to the front edge is adjustable by pivoting on the fixed top member. The variable scaffold support plate includes a releasable locking arrangement for securing the variable scaffold support plate at different angular positions on the fixed top member.

With the founding chair of the invention the variable scaffold support plate can be adjusted on the chair to a generally horizontal position for supporting a post of a scaffolding system. The walls of the boiler vary from boiler to boiler as well as at different positions within a boiler and the variable scaffold support plate allows the installer to effectively level the scaffold support plate and simplifies the securing of scaffolding above the founding chair.

According to an aspect of the invention the fixed top member and the variable support plate cooperate to define a central support surface there between that includes the pivot axis.

In a further aspect of the invention the fixed top surface includes a raised central portion extending between the opposed side members and the variable support plate pivots on the raised central portion.

In a further aspect of the invention the variable support plate includes two upwardly extending flanges extending between the opposed side members and positioned either side of and extending above the planar top surface.

In an aspect of the invention these upwardly extending flanges form part of the locking arrangement.

In a further aspect of the invention the locking arrangement includes locking bolts received in ends of the flanges and received in slots of the opposed side members. The bolts when tightened lock the flanges in a fixed position relative to the opposed side members.

In a preferred aspect of the invention the founding chair is made of an aluminum alloy material to reduce the weight thereof. Preferably the chair is of a weight less than 35 pounds.

In a preferred aspect of the invention the bracing arrangement of the founding chair includes at least two plate members extending between the opposed side members and supporting the fixed top member. In a further aspect to the invention the two plate members include a ported plate position parallel to and adjacent to front edges of the opposed side members.

In yet a further aspect of the invention the side members of the founding chair include at least four notches spaced along the diagonal edge.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
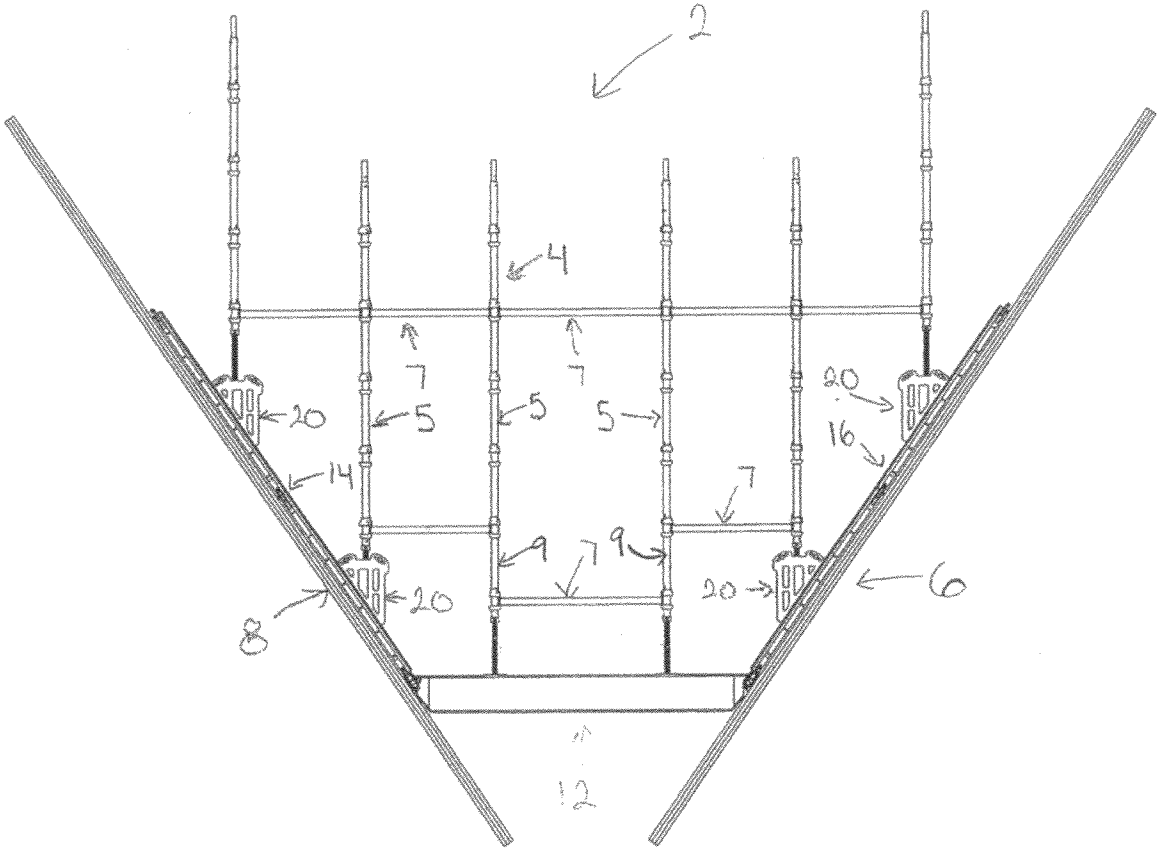
FIG. 1 is a schematic view through a boiler showing the founding ladder system and supporting a scaffolding system.
Figure 2:
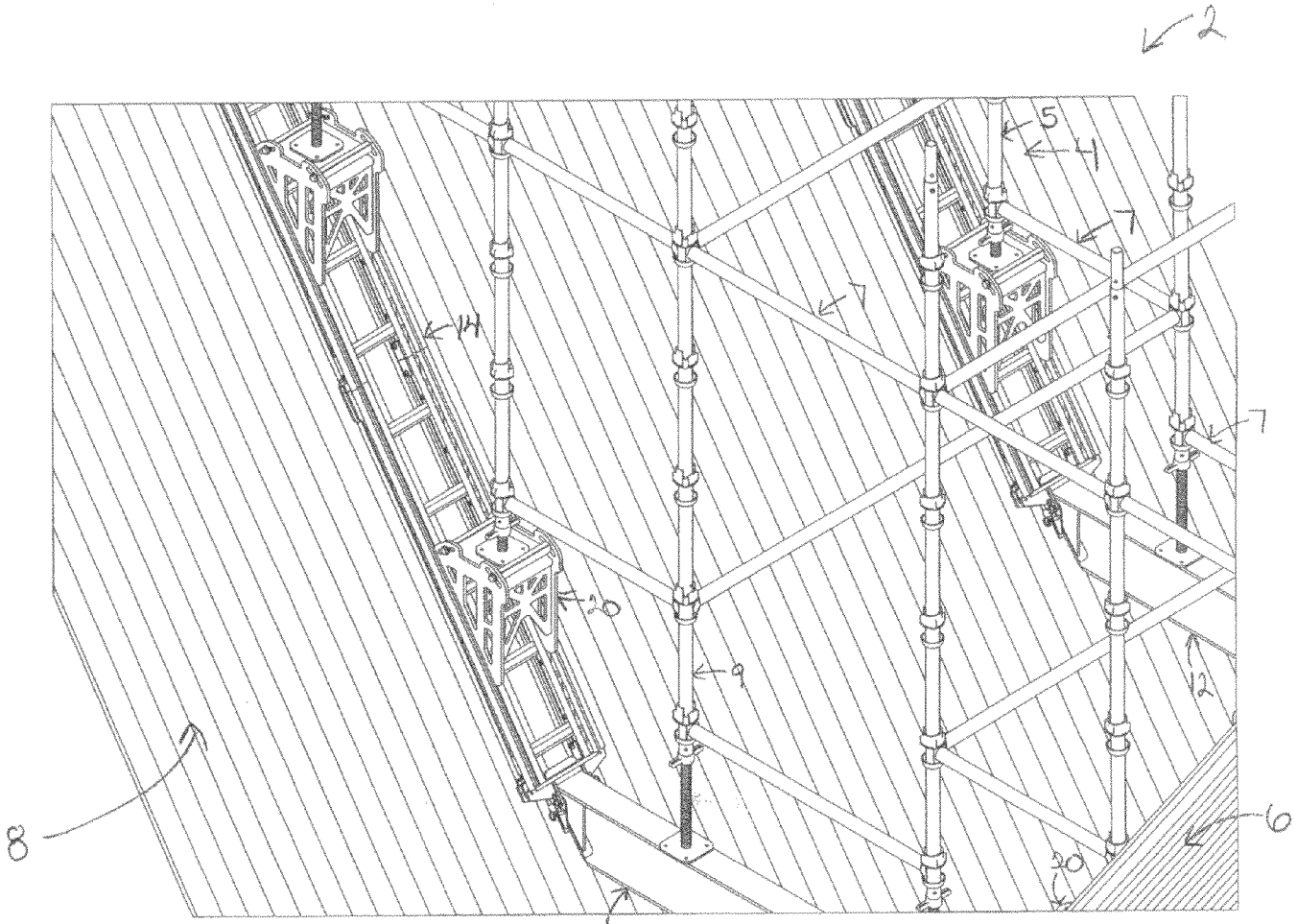
FIG. 2 is a partial perspective view illustrating the founding ladder system within a boiler unit.

The foundry ladder system 2 shown in FIGS. 1 and 2 supports the scaffolding system 4 within the interior of a boiler. The boiler includes lower converging boiler walls 6 and 8. The scaffolding system 4 includes scaffold posts 5 interconnected by lateral bracing members 7.

The elongate base beam 12 effectively spans between the lower converging boiler walls 6 and 8 and supports scaffolding post 9 directly on the upper surface of the elongate base beam 12.

Ladder supports 14 and 16 are positioned at opposite ends of the elongate base beam 12 and extend upwardly and outwardly from the base beam. The ladder supports are in contact with the converging boiler walls 6 and 8. Typically the ladder supports 14 and 16 are made of a plurality of segments that connect together and extend outwardly along the boiler walls.

Each of the ladder supports 14 and 16 support founding chairs 20 and each founding chair supports on an upper surface thereof the leg of a scaffold post. The founding chairs are moveable along the ladder supports 14 and 16 and can engage the ladder support in any plurality of discrete positions. In this way the founding chairs can be appropriately positioned to receive the base of a scaffold post.

With different boilers and even within a particular boiler, the angle of the lower boiler walls can vary and as such the angular position of the ladder support is variable. To overcome this issue, each founding chair includes an adjustable top surface that can be leveled to be perpendicular to the axis of the scaffold support post. The top surface of each founding chair receives the traditional foot plate of the scaffold post and as such the scaffolding system can quickly be erected within the boiler confines once the founding ladder system has been positioned within the boiler.

Figure 3:
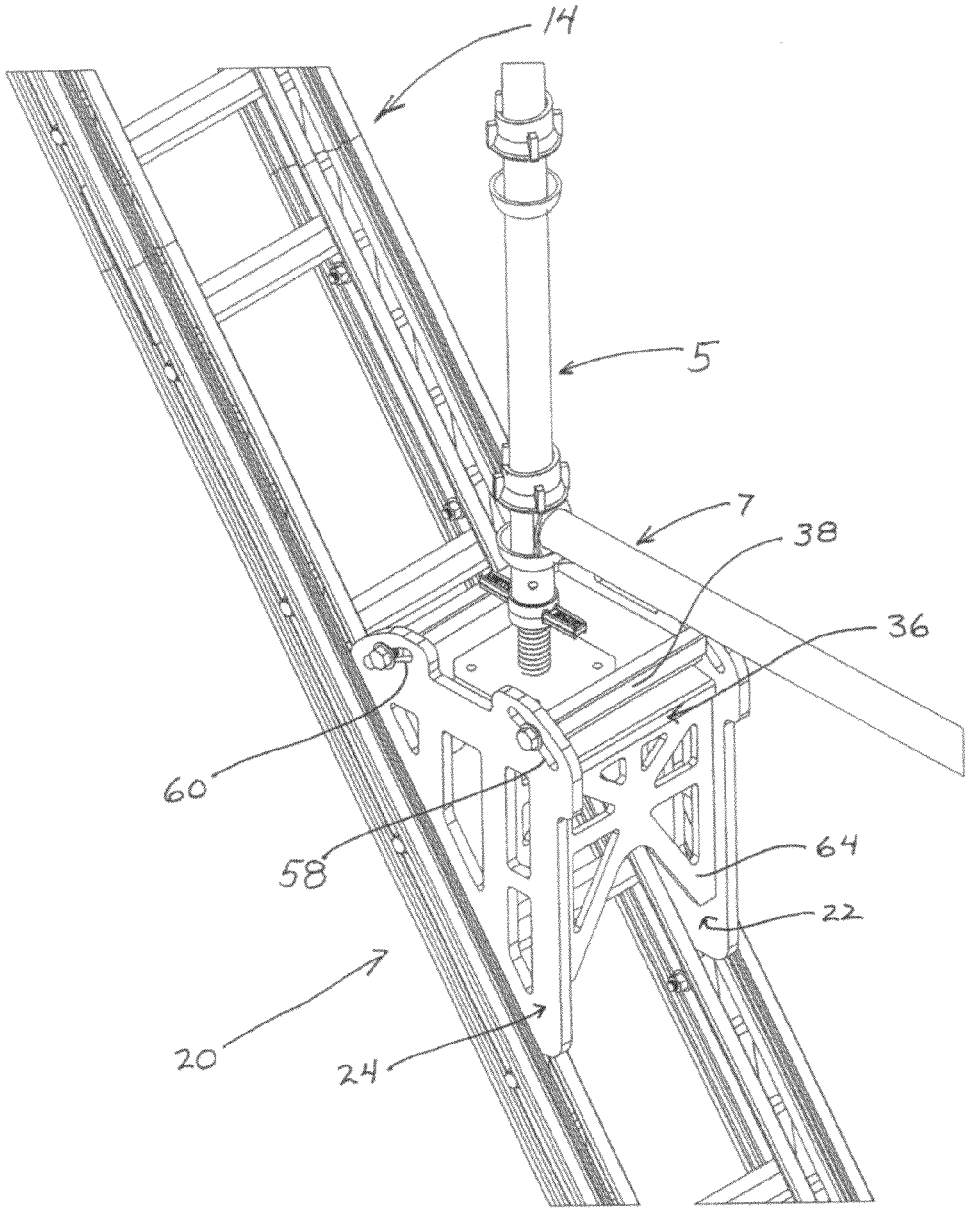
FIG. 3 is a partial perspective view showing details of one of the founding chairs in engagement with a founding ladder.
Figure 4:
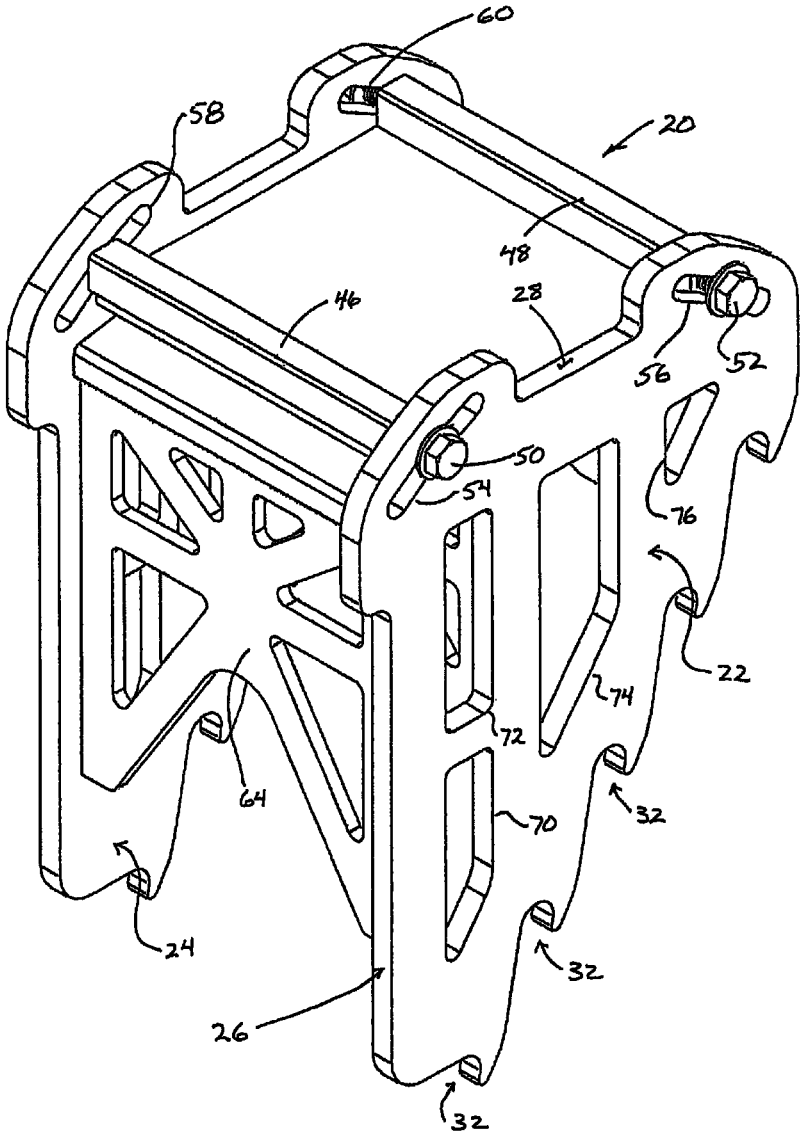
FIG. 4 is a perspective view of the founding chair.
Figure 5:
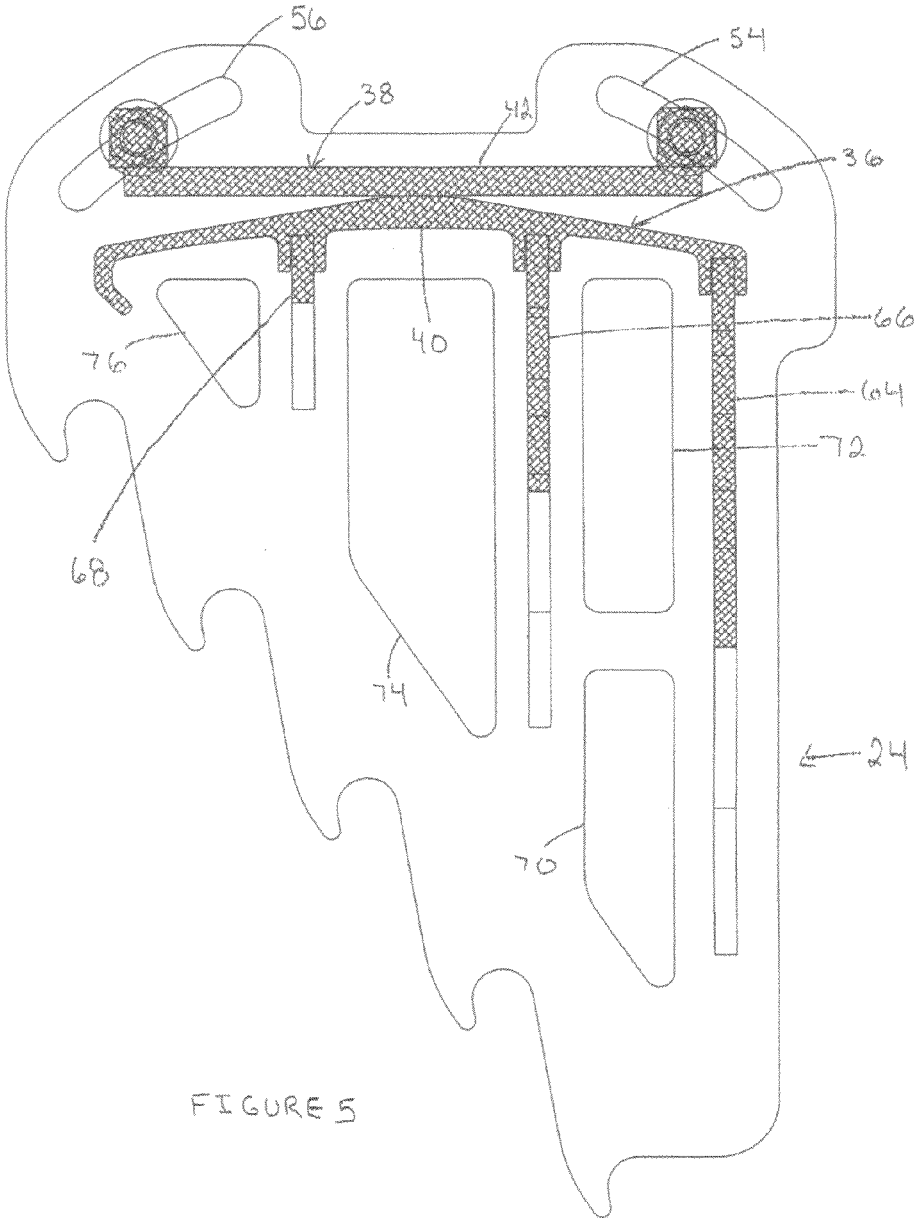
FIG. 5 is a sectional view through the founding chair showing the relationship of the side members, the fixed top member and the variable scaffold support plate.

Details of the founding chair 20 can be appreciated from a review of FIGS. 3 through 5. The founding chair 20 includes two opposed side members 22 and 24 that are adapted to engage the ladder supports 14 and 16. Each of the opposed side members 22 and 24 of a founding chair include a front edge 26, a top edge 28 and a diagonal edge 30 having a series of open notches 32 along the diagonal edge. The opposed side members 22 and 24 are secured by means of bracing plates namely a front bracing plate 64, an intermediate bracing plate 66 and a rear bracing plate 68. Preferably the side members are welded to these brace plates and it is preferable that all of these members are of an aluminum alloy material.

The founding chair as shown in the sectional view of FIG. 5, includes a fixed top member 36 extending between the side members. The fixed top member includes a raised central portion 40 running between the two opposed side members and this provides a support surface for the variable scaffold support plate 38 secured above the fixed top member.

As shown in the sectional view of FIG. 5 the variable scaffold support plate includes a planar portion 42 having upwardly extending thick flanges 46 and 48 to opposite sides of the planar portion. The upwardly extending thick flanges 46 and 48 are orientated to extend between the two opposed side members. These thick flanges include ports for receiving bolt members 50 and 52 shown in the drawings with two bolts provided on each side member. The side members include elongate slots 54, 56, 58 and 60 that receive the bolts and allow pivoting of the variable scaffold support plate when the bolts are in a release position. Once this support plate has been appropriately positioned to provide a horizontal surface for supporting a scaffold post the installer can tighten the bolts and thereby lock the variable plate in position above the fixed top member. As can be appreciated any load exerted by the scaffold post on the variable scaffold support plate is transferred to the opposed side members as well as to the raised central portion of the fixed top member. The front intermediate and rear brace plate support the fixed top plate to effectively transfer the load. Each side member will engage the ladder support at two or more positions and thus the load is thereby transferred to the ladder supports and eventually collected in the elongate base beam 12.

Figure 7:
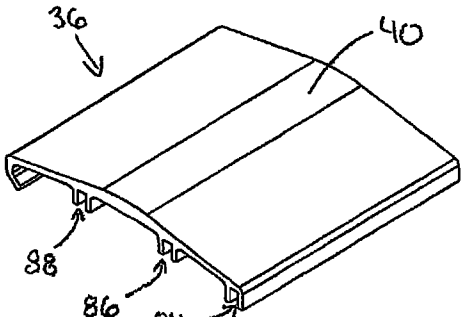
FIG. 7 is a perspective view of the fixed top member;.
Figure 6:
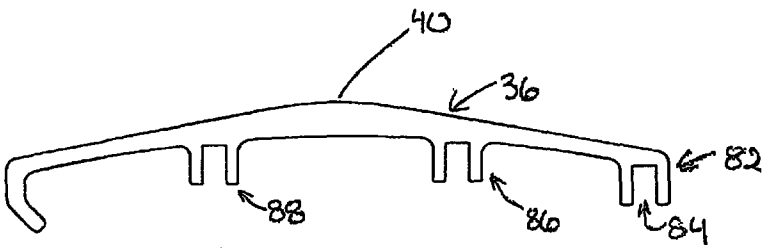
FIG. 6 is an end view of the fixed top member.

FIGS. 6 and 7 show details of the fixed top member 36 which is preferably an extruded member that includes a series of ribs 82, 86 and 88 with each pair adapted to receive the edge of one of the brace plates 64 through 68. For example ribs 82 include the slot 84 for receiving the front brace plate 64. Preferably the brace members are welded to the opposed side members as well as to the top plate to provide an integral fabricated founding chair.

The founding chair is designed to support substantial loads and in previous systems the founding chairs were cast iron or plate steel and weighed approximately 80 pounds. These founding chairs were difficult for the installers to place at the appropriate positions on the ladder supports. In the present system both the brace plates and the side members include a series of ports to reduce the weight of the components. In addition substantially all the components of the founding chair are made of an aluminum alloy material to provide good strength and a reduced weight. The founding chair as shown in the drawings weights approximately 32 pounds and is simpler to install on the ladder supports. The founding chair having a weight between 30 and 35 pounds is easily lifted and installed by a workman and a significant advantage over earlier systems.

Figure 8:
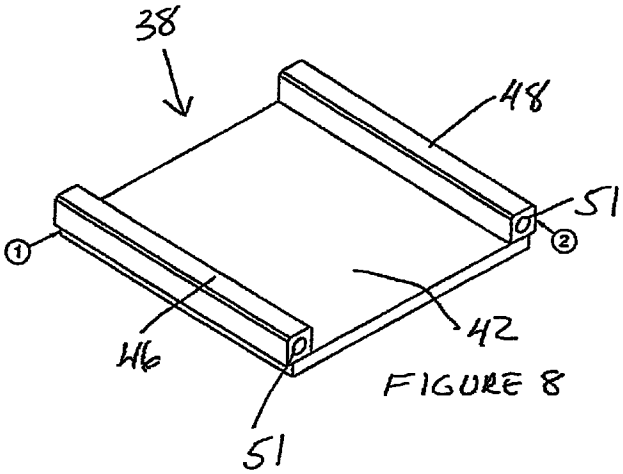
FIG. 8 is a perspective view of the variable scaffold support plate.

FIG. 8 is a perspective view of the variable scaffold support plate 38. It includes the planar portion 42 for receiving a base plate of a scaffold post. Such a base plate is effectively trapped between the two upwardly extending thick flanges 46 and 48 that extend between the side members as well as the raised edges of the side members either side of the planar portion. In this way the base of the scaffold post remains trapped on the planar portion 42. As shown in FIG. 8 each of the thick flanges 46 and 48 at either ends thereof include ports 51 for receiving the bolt members used to fix the variable support plate above the top member.

Figure 9:
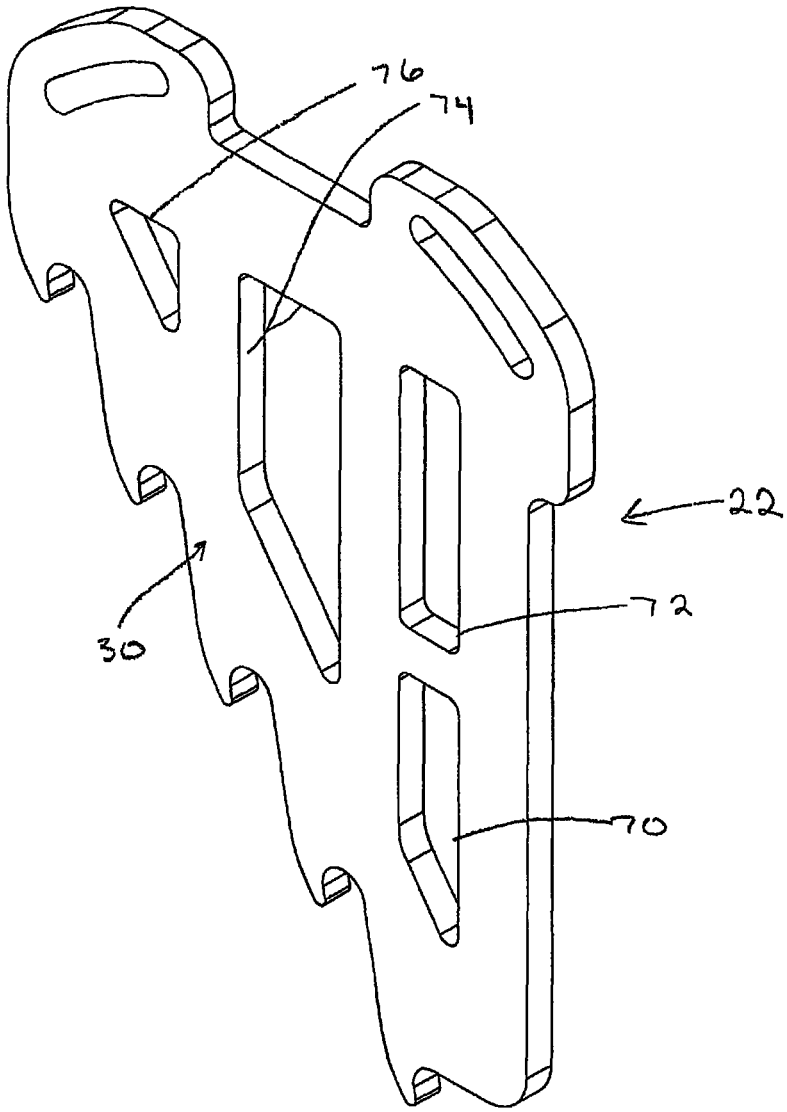
FIG. 9 is a perspective view of one of the side members of the founding chair.

The perspective view of the founding chair shown in FIG. 4 and the perspective view of one of the side members shown in FIG. 9 illustrate that the side members include ports 70, 72, 74 and 76 to reduce the weight of the side members. The side members include continuous elongated portions parallel to the front edge and between ports 72 and 74 as well as between ports 74 and 76. These straight portions provide effective transfer of the force to the series of notches provided on the diagonal edge 30.

Figure 10:
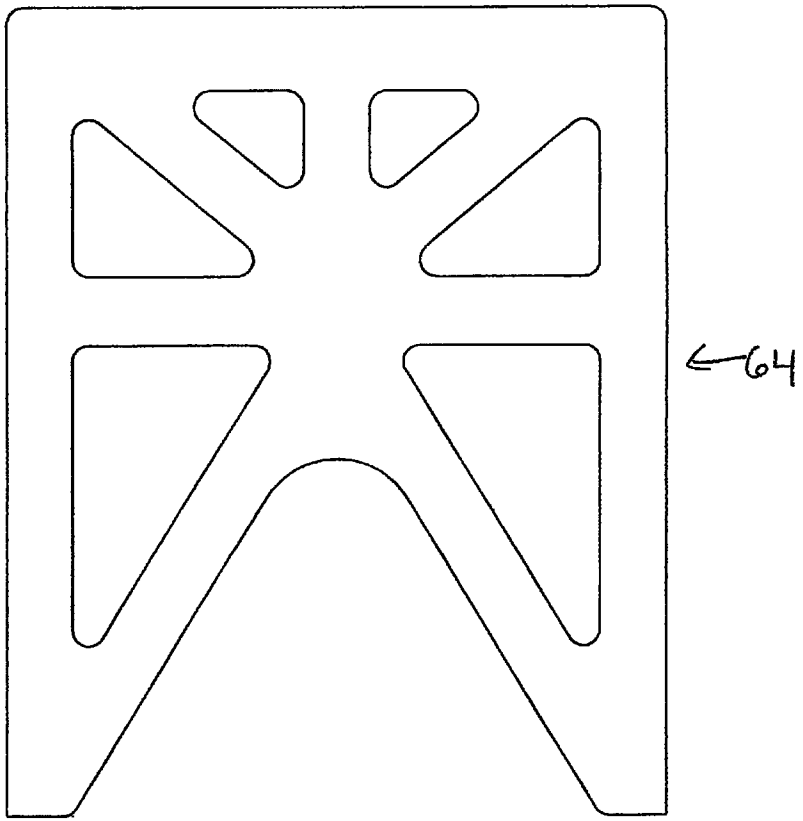
FIGS. 10, 11 and 12 are front views of bracing members of the founding chair.
Figure 11:
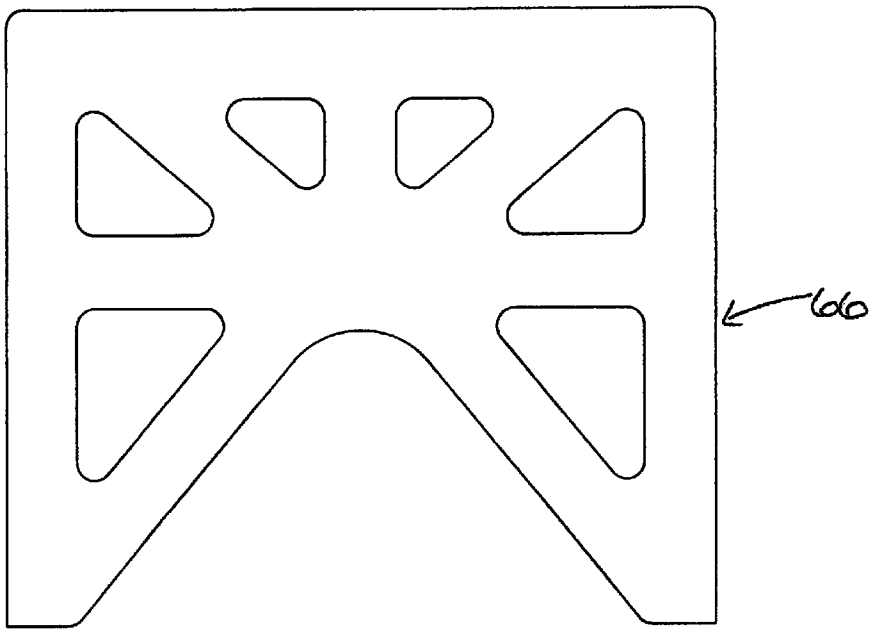
Figure 12:
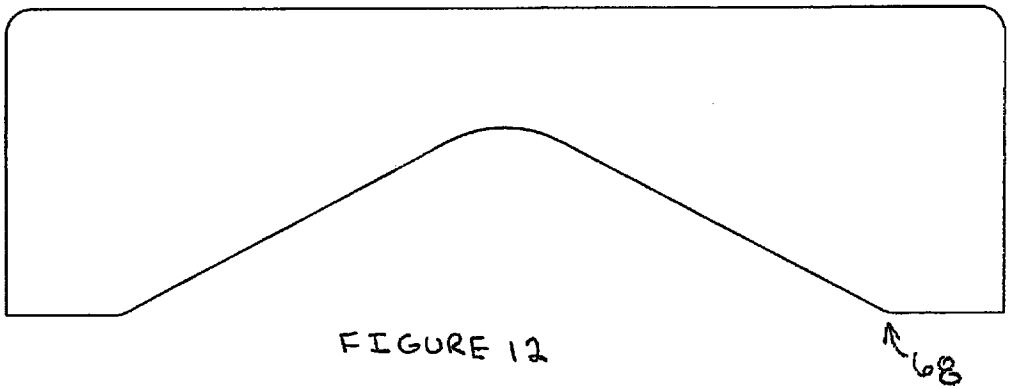

Each of the front, intermediate and rear brace plates shown in FIGS. 10 through 12 also include a series of ports for reducing the weight of the founding chair. The ports are appropriately positioned to provide a network for providing strong bracing while reducing weight.

Figure 13:
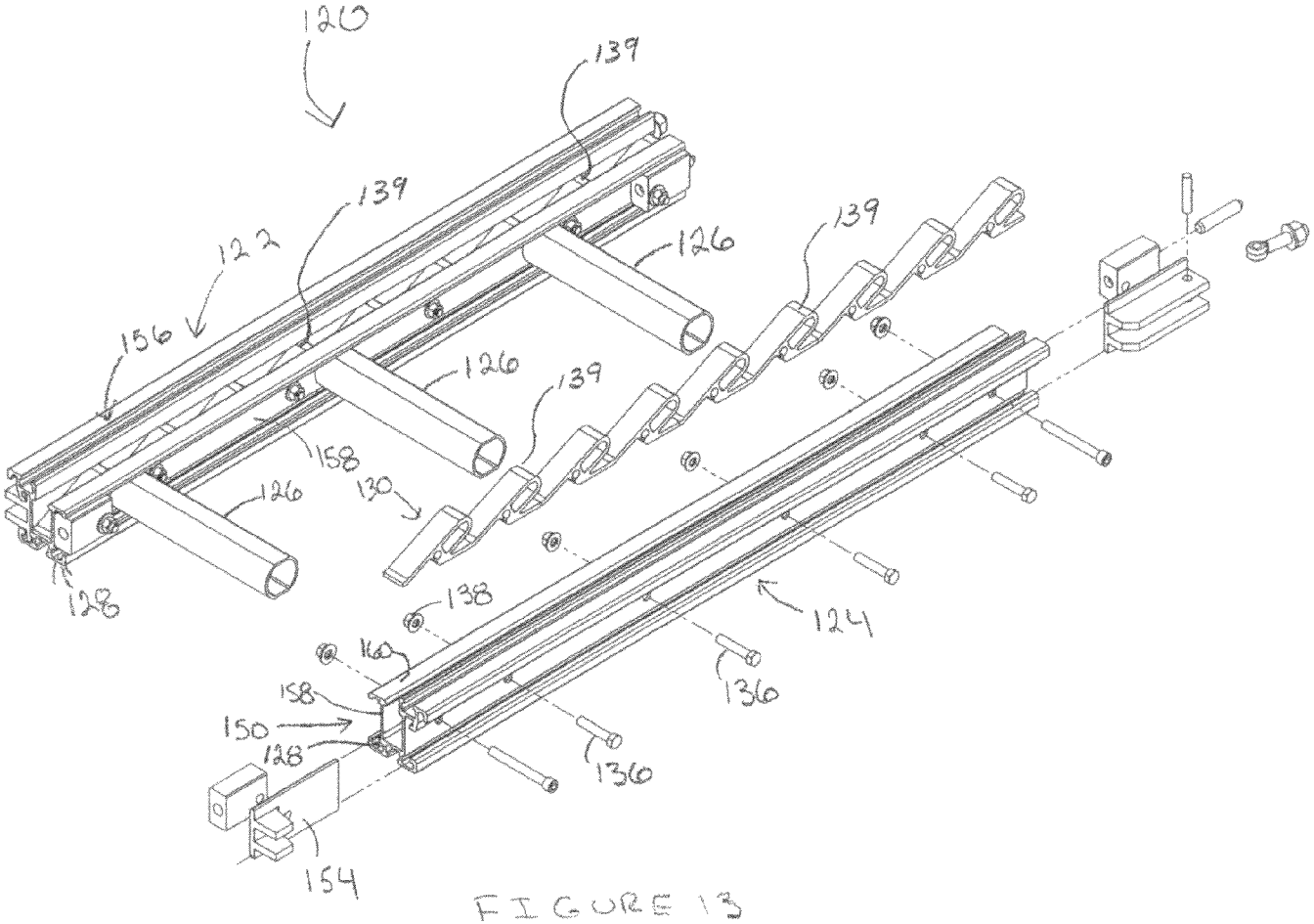
FIG. 13 is a partial exploded perspective view of the founding ladder.

The founding chair as shown in the drawings is designed to engage and be supported by the ladder supports 14 and 16. FIG. 13 illustrates a particular ladder support that includes a series of rounded projections 139 for receipt in one, of these series of notches 32 provided on the founding chair.

FIG. 13 illustrates details of a particular ladder support 120 that includes extruded rail members 122 and 124 having a series of ladder rungs 126 connecting the extruded rail members and appropriately mechanically secured or welded to the rail members. Each of the rail members includes an elongate track 128 that slideably receives engagement rack 130. In FIG. 13 one engagement rack 130 has been positioned within the rail member 122 whereas one engagement rack is shown separately to provide better understanding.

The engagement rack cooperates with the notched edge of the chair members to support the founding chair in a host of positions in the length of the ladder support. With this arrangement each of the notches 32 engage a projection 139 of the engagement rack and acts as a load transfer surface. Furthermore with this system the founding chair can be moved along the ladder support merely by pulling it upwardly and allowing it to cam over a projection 139 on the engagement rack and align with a notch of the founding chair. This provides an incremental-type adjustment rack along the length of the ladder support. The incremental-type adjustment is also helpful with modular scaffolding systems where lateral and diagonal bracing members are of a fixed length. In this case the founding chair can be appropriately located to be directly below a scaffold leg simplifying installation and providing a stable base support.

Figure 15:
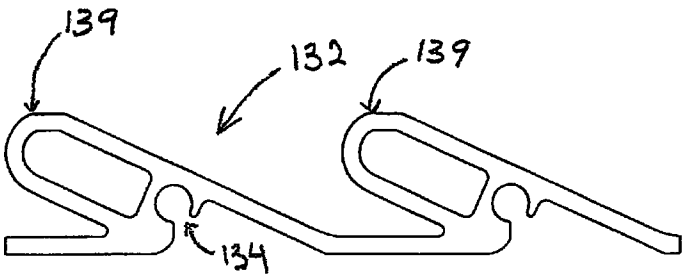
FIG. 15 is a side view of an extruded component inserted in the founding ladder.

Additional details of the engagement rack 130 are shown in FIG. 15. FIG. 15 shows an extruded portion 132 that forms a segment of the engagement rack. This segment includes an extruded bolt-receiving slot 134 and each of the rail members 122 and 124 have a series of ports extending therethrough for receiving the fastening bolts 136. Nuts 138 are provided on the opposite side of the extruded rail members to thereby lock the engagement rack 130 in position. The segments 132 include projections 139 which are received in the notches 32.

Preferably these engaging racks are slideably received within the tracks 128 that are partially closed to retain the engagement racks of the extruded rail members 122. In this way the engagement rack is basically retained within the open slot of the rail members and is fixed in position along the length of the rail members by the bolt and nut securement. This provides a simplified manufacture of the ladder. In addition with this arrangement the rungs of the ladder remain clear and are not required to provide the engagement surface with the founding chairs. These rungs obviously can be used if an installer temporarily wants to rest the founding chair on a rung.

Figure 14:
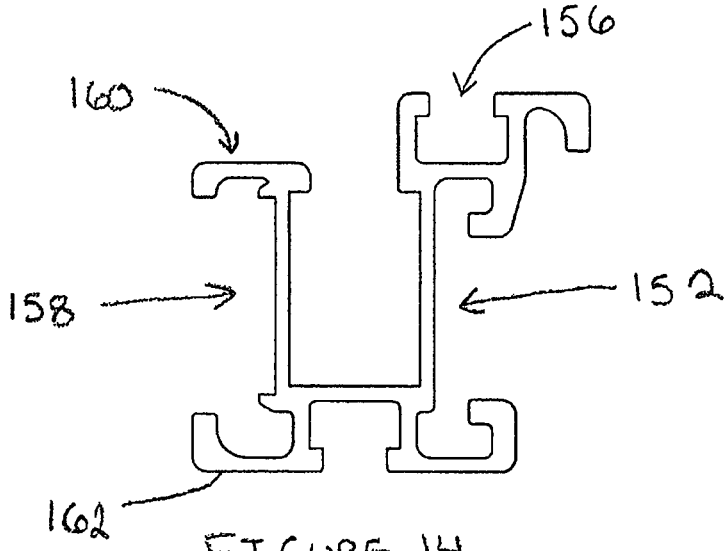
FIG. 14 is a sectional view through one of the rails of the founding ladder.

FIG. 14 provides details of the extruded rail members 122 and 124. These rail members include an outer side wall having an elongate slot 152 on the side thereof that receives a founding ladder spigot 154. This spigot can also be retained by a bolt connection such as one of the bolts 136. The top outer edge of each rail member 122 and 124 includes an upwardly opening bolt slot 156.

Each of the rails 122 and 124 include an inner side member 158 having an inwardly extending flange 160 and an inwardly extending bottom flange 162.

Figure 16:
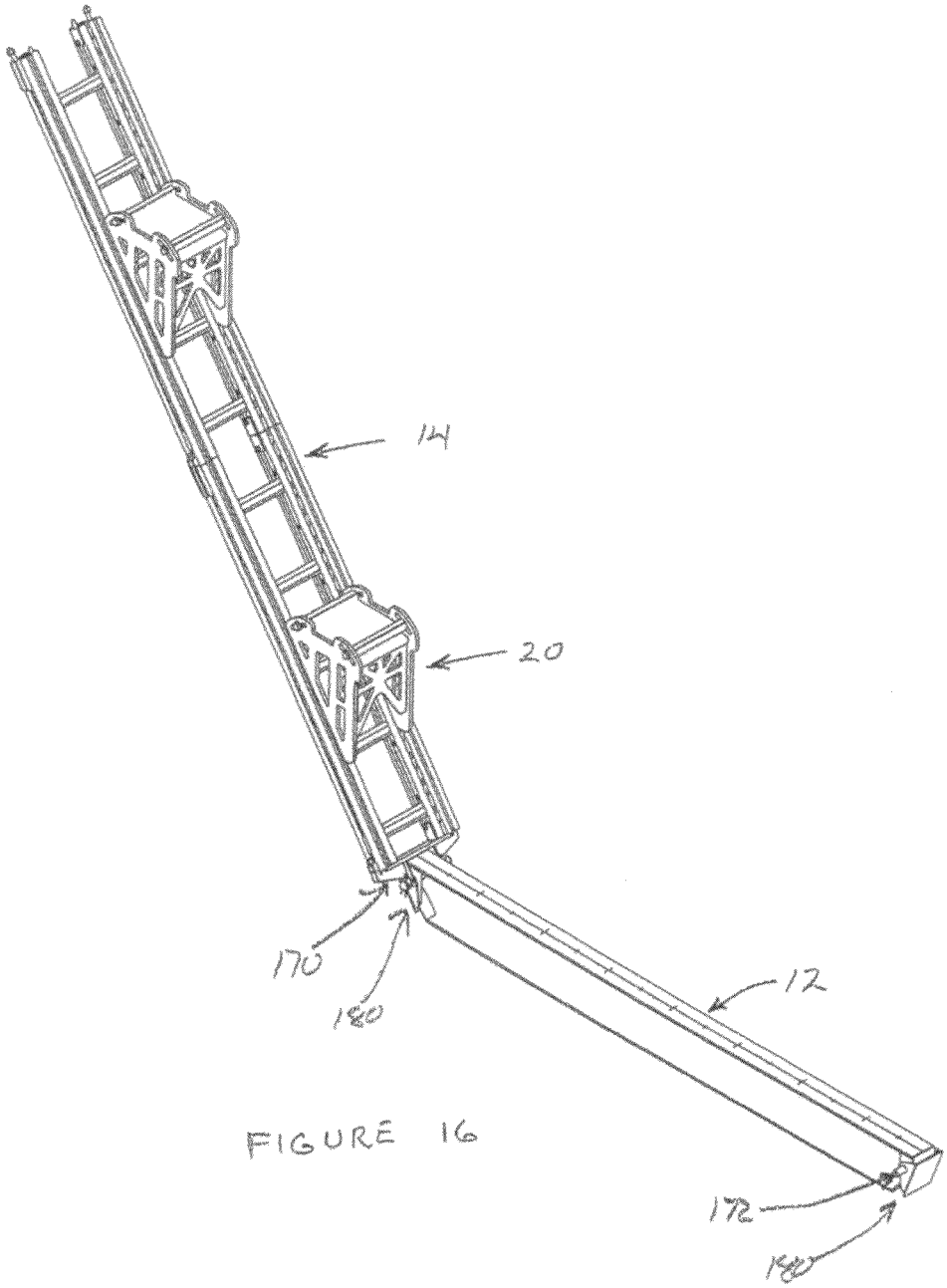
FIG. 16 is a perspective view showing the cooperation between the founding ladder and the base beam.
Figure 17:
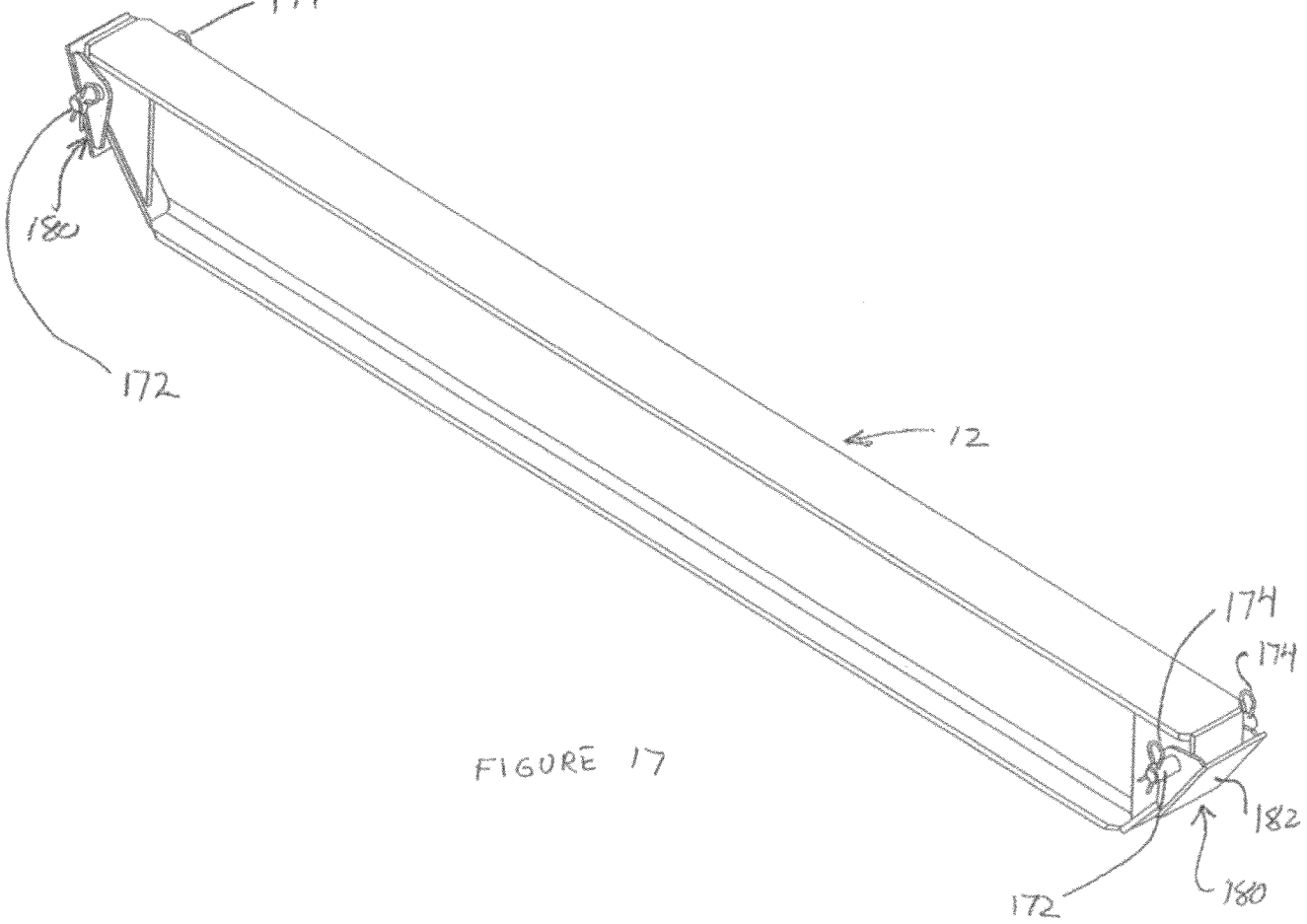
FIG. 17 is a perspective view of the base beam.
Figure 18:
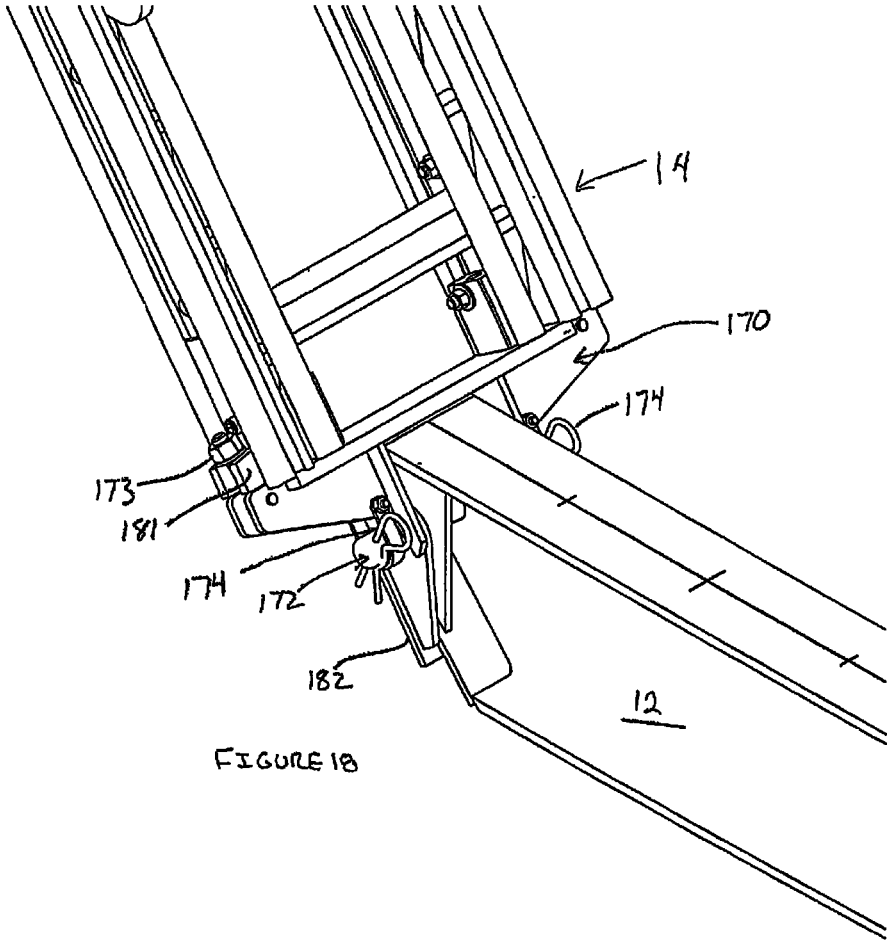
FIG. 18 is a partial perspective view showing the engagement of the founding ladder with the end of the base beam.

As discussed with respect to the founding chair, the particular angle of the ladder support relative to the base beam is essentially determined by the angle of the lower boiler walls. With this arrangement the ladder supports must engage the base beam in an adjustable manner. FIGS. 16, 17 and 18 show additional details of the elongate base beam 12 and the securement of the ladder at the ends of the base beam.

The base beam 12 as shown in FIGS. 17 and 18 includes pivoting brackets 180 pivotally secured to the ends of the beam 12 by means of the removable securing pin 172. Bracket 180 includes a face plate 182 for engaging the angled walls of the foundry system. The pivoting bracket 180 engages the walls of the foundry system and transfers any loads that are exerted on beam 12 to the foundry system walls. With this arrangement, the support beam 12 automatically adjusts for variations in the angles of the foundry system walls.

The securing pins 172 include at opposite ends thereof removable keepers 174 allowing a removal of the bracket 182 from the ends of the beam 12, and will also allow removal and securement of a ladder to the base beams 12. The base beam 12 is generally of an I-beam cross section, and the ends of the beam are effectively boxed for securement of the securing plate 180.

Figure 19:
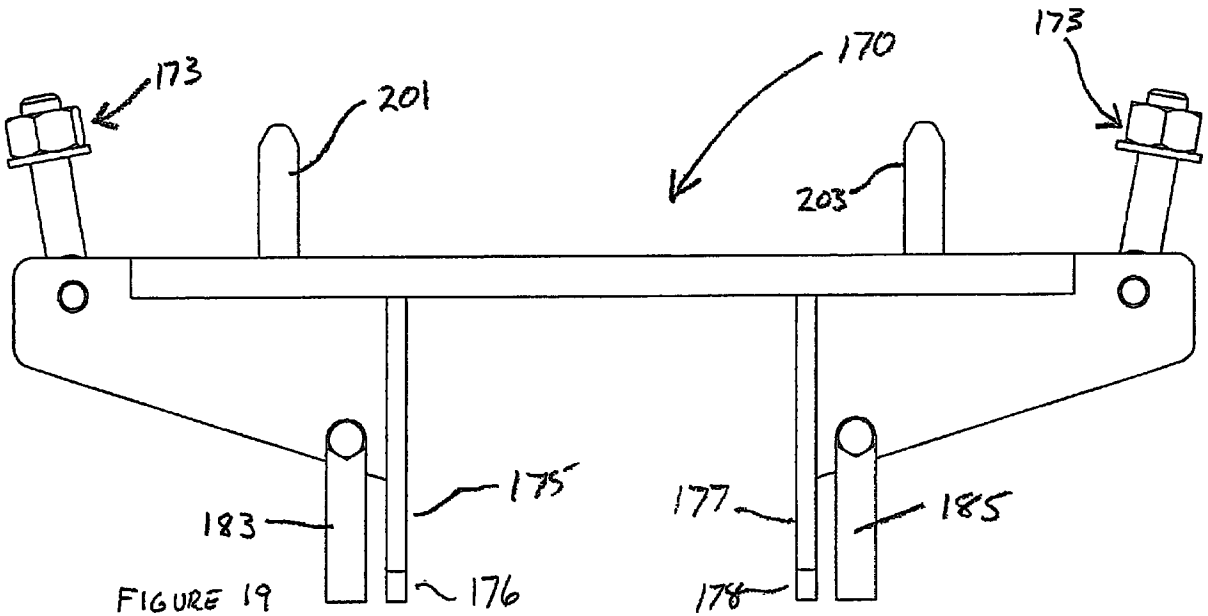
FIG. 19 is a side view of a ladder support insert used to engage a base beam.
Figure 20:
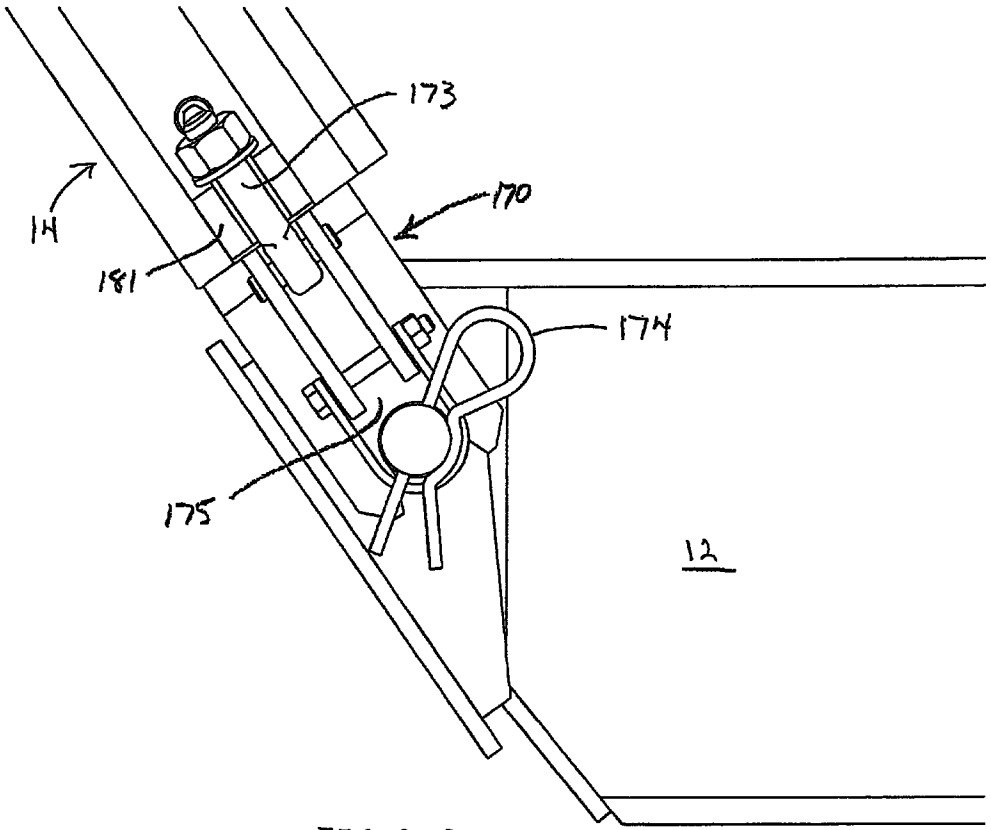
FIG. 20 is a partial side view of the securement of a ladder to the base beam.
Figure 21:
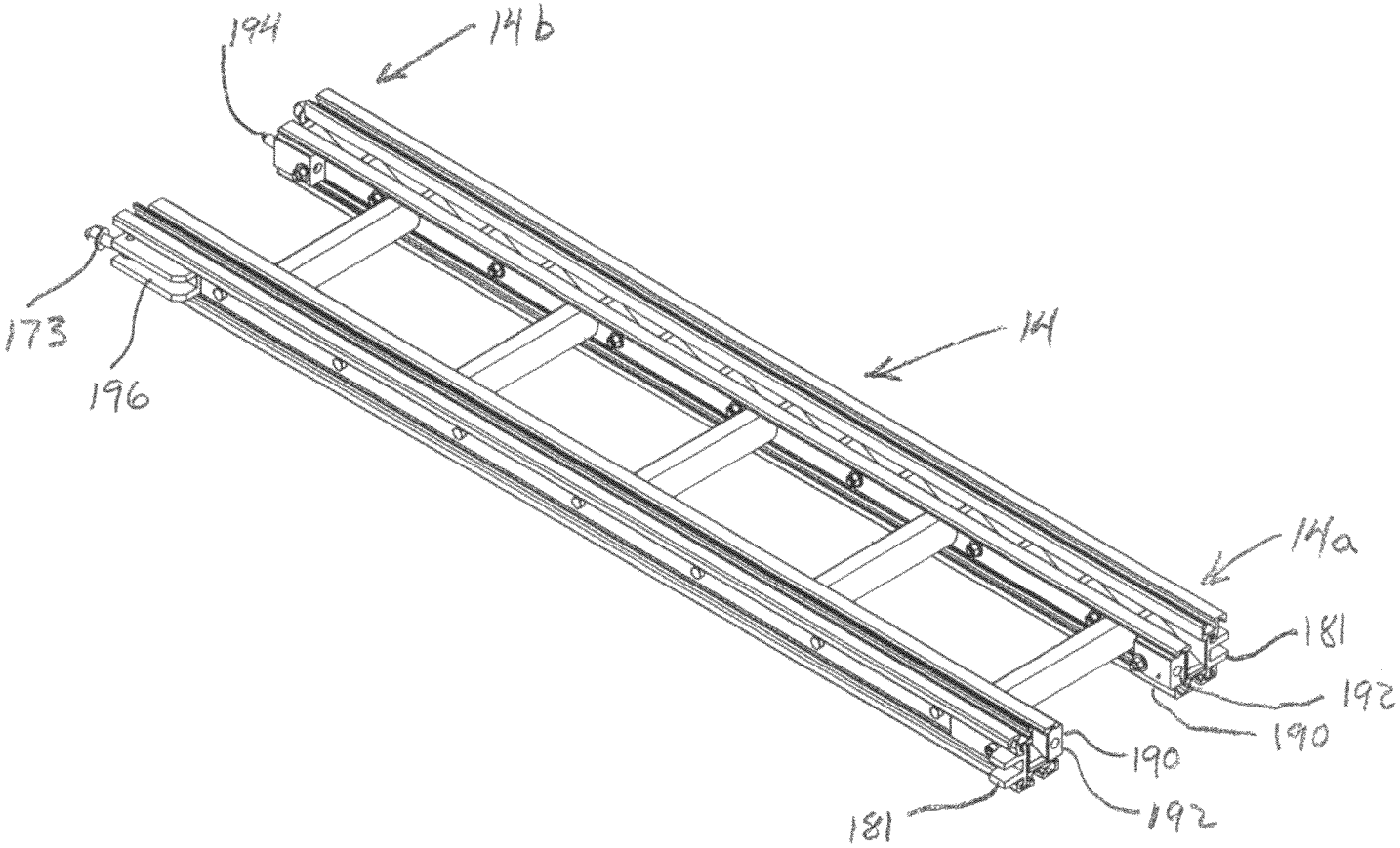
FIG. 21 is a perspective view of a preferred founding ladder.

As shown in FIG. 18, the ladder 14 includes the ladder support insert 170 that is mechanically secured to the end of the ladder 14 by pivoting bolt members 173. These bolt members cooperate with the U-shaped securing lugs 181 fixed on the ends of the ladder 14. Typically, the ladder support insert will be secured to certain ladders to allow these ladders to engage and be supported from the support beam 12. The bracket 170 as shown in FIG. 19 includes extending arms 175 and 177 that include recesses 176 and 178 for engaging the removable securing pin 172. The bracket also includes fixed securing loops 183 and 185 that also allow passage of the securing pin 172 and effectively fix the ladder to the pivoting bracket 180. The ladder 14 shown in FIG. 18 can be removed by release of one of the keepers 174 and withdrawing the securing pin. In this way, the bracket 170 remains fixed to the end of the ladder and can be reinstalled to the base beam at a different point in time. The ladder 14 as shown in FIG. 20 includes a bottom portion 14*a* and a top end portion 14*b*. The bottom portion 14*a* includes the securing lugs 181 and, on an inside surface of each rail, includes a block member 190 having a guide port 192. The guide ports 192 are positioned for receiving the guide pins 194 provided at the top end 14*b*. The top portion 14*b* also includes a bracket 196 that includes pivoting securing bolts 173. With this arrangement, ladder sections 14 can be stacked one above the other, and a mechanical securement is provided therebetween. The ladder sections 14 can be disengaged for storage, transportation or to assist in gaining access to restricted areas.

As shown in FIG. 19, the ladder insert 170 includes on opposite sides thereof the pivoting securing bolts 173 for engaging securing lugs 181 provided on the base portion of a ladder 14. In addition, the ladder support insert 170 includes guide pins 201 and 203 for engagement in the guide ports provided at the base of the ladder. With this arrangement, the ladder support insert 170 can easily be assembled on an end of any of the ladder sections 14 for engaging a base beam 12.

It can be appreciated that other arrangements for securing of the ladders and the design of the ladder and its engagement with the support beam 12 can be used. A particular mechanical arrangement has proven effective, and simplifies the installation and the ability to alter the structure as it is assembled in a foundry system. This arrangement also simplifies removal of the system once the particular maintenance on the foundry system has been completed.

There are a number of unique aspects with respect to this particular system. The ladder supports can be made of relatively short lengths to facilitate moving the system into the inside of the boiler as access to the boiler is often limited. These ladder segments can be made in six foot lengths, for example, and can easily pass through an inspection port. Once inside the boiler the ladder segments can be connected to form an appropriate length for supporting of the scaffolding. Each of the ladders are easily assembled atop the elongate base beam 12.

Once the ladder supports are in position the founding chairs may be moved to appropriate positions along each of the ladder supports for supporting of scaffold support posts. Typically the scaffold support posts can be provided at the normal standard grid separation particularly due to the incremental adjustment of the founding chairs on the ladder supports. The founding chairs are of reduced weight and therefore are more easily positioned.

It has been found that this system simplifies installation and increases the speed of installation of the ladder support system as well as the scaffolding system. This allows faster maintenance of the boiler and will allow the boiler to return to active service more quickly. Typically this type of boiler maintenance is extensively planned to reduce the downtime of the boiler.

Although preferred embodiments of the present invention have been described herein in detail, it will be appreciated by those skilled in the art, that variations may be made thereto without departing from spirit of the invention or the scope of the appended claims.

The embodiments of the invention in which an exclusive property or privilege is claimed are defined as follows:

1. A founding chair for a founding ladder system, said founding chair including two opposed side members with each side member including a front edge, a top edge, and a diagonal edge; said diagonal edge including a series of open notches for adjustably securing said founding chair to a founding ladder; said founding chair including a fixed top member extending between said opposed side members and generally parallel to and positioned below said top edge;

a bracing arrangement extending between said opposed side members and below said fixed top member; and a variable scaffold support plate positioned above and in engagement with said fixed top member; said variable scaffold support plate including a planar top surface; said variable scaffold support plate pivoting on said fixed top member about a pivot axis extending across said fixed top member whereby an angular position of said planar top surface relative to said front edge is adjustable, wherein said fixed top member and said variable support plate cooperate to define a central support surface therebetween that includes said pivot axis, said variable scaffold support plate including a releasable locking arrangement for securing said variable scaffold support plate at different angular positions on said fixed top member; wherein said fixed top surface includes a raised central portion extending between said opposed side members and said variable support plate pivots on said raised central portion.

2. A founding chair as claimed in claim 1 wherein said variable support plate includes two upwardly extending flanges extending between said opposed side members and positioned on either side of and extending above said planar top surface.

3. A founding chair as claimed in claim 2 wherein said upwardly extending flanges form part of said locking arrangement.

4. A founding chair as claimed in claim 3 wherein said locking arrangement includes locking bolts received in ends of said flanges and received in slots of said opposed side members; said bolts when tightened locking said flanges in a fixed position relative to said opposed side members.

5. A founding chair as claimed in claim 3 wherein said founding chair is made of an aluminum alloy.

6. A founding chair as claimed in claim 5 wherein said bracing arrangement includes at least two plate members extending between said opposed side members and supporting said fixed top member.

7. A founding chair as claimed in claim 6 wherein said at least two plate members include a ported plate positioned parallel to and adjacent the front edges of said opposed side members.

8. A founding chair as claimed in claim 7 wherein each side member between said at least two plate members include elongate ports sized to reduce the weight of said side members by at least 25%.

9. A founding chair as claimed in claim 8 wherein said series of open notches of each side member include at least 4 notches spaced along said diagonal edge.

10. A founding chair as claimed in claim 1 wherein said founding chair is fabricated and of an aluminum alloy material.

11. A founding chair as claimed in claim 1 wherein said variable scaffold support plate is an extruded member and includes two upwardly extending flanges positioned on opposite sides of the support plate and extending between said opposed side members.

12. A founding chair as claimed in claim 11 wherein each upwardly extending flange includes at opposite ends thereof a bolt receiving recess aligned with a bolt receiving slots of said side members, and forms part of said releasable locking arrangement.

13. A founding ladder system comprising an elongate base beam spanning between converging lower boiler walls;

a pair of ladder supports secured to opposite ends of said elongate base beam and extending upwardly and outwardly and supported by the lower boiler walls;

each ladder support releasably supporting at least one founding chair according to claim 1, said chair having an adjustable and lockable top surface allowing leveling and locking of said top surface with changes in angle of said ladder support.

14. A founding ladder system as claimed in claim 13 wherein each founding chair is fabricated from plate and extruded components of an aluminum alloy material.

15. A founding ladder as claimed in claim 14 wherein each founding chair is of a weight less than 35 pounds.

16. A founding ladder system as claimed in claim 13 wherein each ladder support includes two opposed side rails with a series of rungs extending between said side rails;

each side rail including a pair of spaced elongate supports and an upwardly opening central slot extending in a length thereof, and a series of founding chair support positions defined within each upwardly opening central slot.

17. A founding ladder system as claimed in claim 16 wherein each founding chair comprises opposed side members with each side member including a front edge, a top edge, and an angled diagonal edge; said diagonal edge including a series of open notches for adjustably securing said founding chair to one of said ladder supports; each founding chair including a fixed top member extending between said opposed side members and generally parallel to and positioned below said top edge; a bracing arrangement extending between said opposed side members and below said fixed top member; and a variable scaffold support plate positioned above and in engagement with said fixed top member; said variable scaffold support plate including a planar top surface; said variable scaffold support plate pivoting on said fixed top member about an axis extending across said fixed top member whereby an angular position of said planar top surface relative to said front edge is adjustable; said variable scaffold support plate including a releasable locking arrangement for securing said variable scaffold support plate at different angular positions on said fixed top member.

18. A founding ladder system as claimed in claim 17 wherein said fixed top surface of each founding chair includes a raised central portion extending between said opposed side members and said variable support plate pivots on said raised central portion.

* * * * *